US007373696B2

(12) United States Patent
Schoening et al.

(10) Patent No.: US 7,373,696 B2
(45) Date of Patent: May 20, 2008

(54) APPARATUS AND METHOD FOR HOLDING GARMENTS

(76) Inventors: Brian Schoening, 1995 Wildwood La., Hanover Park, IL (US) 60133; Stephen E. Dorgan, 1225 Clover La., Hoffman Estates, IL (US) 60195; Michael R. Capesius, 6 Redwood Ct., Streamwood, IL (US) 60107; Szymon Latawiec, 11604 S. Olympic Dr., Plainfield, IL (US) 60544

( * ) Notice: Subject to any disclaimer, the term of this patent is extended or adjusted under 35 U.S.C. 154(b) by 110 days.

(21) Appl. No.: 10/918,882

(22) Filed: Aug. 16, 2004

(65) Prior Publication Data

US 2006/0032026 A1 Feb. 16, 2006

(51) Int. Cl.
*A41D 25/04* (2006.01)

(52) U.S. Cl. ..... 24/66.1; 24/303

(58) Field of Classification Search ..... 24/49–66.13, 24/303

See application file for complete search history.

(56) References Cited

U.S. PATENT DOCUMENTS 517,769 A * 4/1894 Selowskiy ..... 2/144
2,389,298 A * 11/1945 Ellis ..... 335/303
2,397,931 A 4/1946 Ellis
2,599,421 A * 6/1952 Wilm ..... 2/116
2,601,424 A 6/1952 Baker
3,161,932 A * 12/1964 Russell ..... 24/303
3,827,019 A * 7/1974 Serbu ..... 335/285
3,827,108 A 8/1974 Jewett
4,835,821 A * 6/1989 Durante ..... 24/66.1
5,073,987 A * 12/1991 Crosier ..... 2/144
D351,491 S * 10/1994 Just ..... D2/605
5,435,011 A * 7/1995 Nicolai et al. ..... 2/145
5,604,960 A * 2/1997 Good ..... 24/66.1
5,732,451 A 3/1998 Mars
5,974,634 A 11/1999 Eisenpresser (Continued)

FOREIGN PATENT DOCUMENTS

JP 2000345412 A * 6/1999

OTHER PUBLICATIONS

"The World's Strongest Magnets!," dated Aug. 13, 2004, from the internet website of Forcefield, at http://www.wondermagnets.com, 2 pages.

(Continued)

*Primary Examiner*—Robert J Sandy
*Assistant Examiner*—Ruth C Rodriguez
(74) *Attorney, Agent, or Firm*—Neal, Gerber & Eisenberg LLP

(57) ABSTRACT

An improved apparatus and method for holding garments, such as neckties, is disclosed. The device comprises a magnet, preferably made of a rare Earth material and magnetized to about Grade N35 or better, and a faceplate. In one embodiment, the magnet is positioned under at least a portion of the wearer's shirt while the faceplate is positioned on a portion of the wearer's necktie. The shirt and/or necktie may additionally include pockets for housing the magnet and/or faceplate. The faceplate may be decorative, and interchangeable, for prominent display in front of the necktie. Alternatively, the device may be configured to be completely hidden from view. Several means for retaining the magnet to the shirt upon separation of the garments are presented.

14 Claims, 7 Drawing Sheets

U.S. PATENT DOCUMENTS

| | | | | |
|---|---|---|---|---|
| 6,216,275 | B1 | 4/2001 | Lee | |
| 6,266,823 | B1 * | 7/2001 | Padoan | 2/144 |
| 6,434,801 | B2 * | 8/2002 | Grunberger | 24/66.1 |
| D482,511 | S * | 11/2003 | Dixson | D2/605 |
| 2005/0023420 | A1 * | 2/2005 | Sadeh et al. | 248/206.5 |

OTHER PUBLICATIONS

"Categories>>Discs," dated Aug. 13, 2004, from the internet website of K&J Magnetics, Inc., at http://www.kjmagneticscom, 2 pages.

* cited by examiner

APPARATUS AND METHOD FOR HOLDING GARMENTS

BACKGROUND OF THE DISCLOSURE

1. Field of the Invention

The present invention relates in general to garment securement devices, and particularly, to necktie holders for securing one's necktie to itself and to dress shirts.

2. Background Art

Historically, garments worn by a person have been fastened together using buttons, belts, snaps, zippers, hook-and-loop fasteners, and the like. Permanent magnets have also been used to secure garments together, such as the magnetic button disclosed in U.S. Pat. No. 2,397,931 issued to Ellis, the magnetic button disclosed in U.S. Pat. No. 5,974,634 issued to Eisenpresser, and the magnetic attaching device disclosed in U.S. Pat. No. 5,732,451 issued to Mars. But permanent magnets made of traditional materials have not been capable of securely fastening multiple layers of clothing together due to their relatively weak magnetic field strengths. The emergence of high field strength permanent magnets in the marketplace has brought with them new utilitarian uses.

Neckties, in particular, have historically been secured to one's dress shirt using a broad array of spring clips, clasps, tacks, chains, and the like. However, conventional necktie holders such as these suffer from several shortcomings; namely, they may not be completely hidden from view, they may not have interchangeable decorative faceplates, they may not fixedly attach the necktie against the surface of the shirt, they may damage clothing by leaving a hole through the necktie and/or the shirt, and they may not permit easy separation of the ornamental end of the necktie from the shirt while simultaneously retaining the necktie holder.

In addition, conventional necktie holders can be dangerous for those persons who are required to wear a break-away necktie (i.e. clip-on tie) in their professions because conventional necktie holders are incapable of allowing the necktie to smoothly separate from the wearer's neck if the necktie were to become caught in machinery, for example.

Some necktie holders are known to include magnets as a means for securing a necktie to one's shirt. For example, U.S. Pat. No. 2,601,424 issued to Baker discloses a necktie holder having a composite faceplate incorporating both a magnet and a decorative plate in combination with a magnetic spring clip that is clamped onto person's shirt. However, Baker neither teaches nor suggests that all of the components of the necktie holder are completely hidden from view. Likewise, U.S. Pat. No. 6,216,275 B1 issued to Lee discloses a device for securing neckties that also incorporates a magnet. However, Lee neither teaches nor suggests a necktie holder capable of fixedly attaching the necktie to be in direct contact with the surface of the shirt.

Therefore, it would be desirable to provide a necktie holder that is completely hidden from view. It would also be desirable to provide a necktie holder that has interchangeable faceplates. It would also be desirable to provide a necktie holder that fixedly attaches the necktie against the surface of the wearer's shirt. It would also be desirable to provide a necktie holder that does not damage the wearer's clothing. It would also be desirable to provide a necktie holder for enhanced personal safety, yet all quick and easy separation of the necktie from the wearer's shirt to minimize damage to the necktie, as when washing hands or when eating a meal. It would also be desirable to provide a necktie holder that is retained by the wearer's clothing even when the necktie becomes separated from the wearer's shirt. It would also be desirable to provide a necktie holder that allows the necktie to move within a limited range dictated by the length of a tether, but which does not damage the wearer's clothing. It would also be desirable to provide a necktie holder that permits a single, seemingly unitary separation of the necktie from the wearer (if combined with a clip-on necktie) should the necktie become caught in machinery or otherwise pose harm to the wearer.

SUMMARY OF THE INVENTION

The present invention is directed to a magnetic device for securing a necktie to a wearer's shirt generally comprising a magnet that is magnetized to about Grade N35 and a faceplate that is magnetically attractable to the magnet. The magnet is preferably encased in a hard and durable coating for corrosion resistance.

In accordance with one aspect of the present invention, the magnet is positionable underneath at least a portion of the wearer's shirt, and the faceplate is likewise positionable within magnetic proximity to the magnet to cause releasable restraint of the necktie relative to the shirt at the location of the magnet. The magnet and the faceplate are preferably hidden from view. However, because the faceplate may be decorative in nature, the wearer may choose to install the faceplate on the front panel of the necktie for prominent display. The faceplate may be interchangeable with other faceplates of different ornamental design. The faceplate is optionally made of a rare Earth material magnetized to about Grade N35.

A method for using a magnet in combination with a faceplate for securing a necktie to a shirt is presented in accordance with another aspect of the present invention. The necktie comprises an ornamental end and a nonornamental end that is positioned behind a transverse piece of fabric secured to the rear portion of the ornamental end. The method comprises the steps of: (1) placing and holding the magnet underneath at least a portion of the shirt with one hand; (2) placing and holding the faceplate behind at least the transverse piece of fabric with the other hand; and (3) drawing the faceplate toward the magnet to become within magnetic proximity of one another to cause releasable fixation of the necktie relative to the shirt at the location of the magnet. The magnet may optionally be magnetized to about Grade N35 and may optionally be comprised of a rare Earth material that is encased in a hard and durable coating to protect it from corrosion. The coating on the magnet may optionally comprise at least nickel or epoxy. Placement of the faceplate behind the transverse piece of fabric may additionally occur between the ornamental end and the nonornamental end of the necktie.

Another method for using a magnet in combination with a faceplate for securing a necktie to a shirt is presented in accordance with one aspect of the present invention. The necktie comprises an ornamental end and a nonornamental end that is positioned behind a transverse piece of fabric secured to the rear portion of the ornamental end. The method comprises the steps of: (1) placing the magnet in a first pocket secured underneath a portion of the shirt; (2) placing the faceplate in a second pocket secured to the rear side of the ornamental end; and (3) drawing the necktie toward the shirt to cause the faceplate to become within magnetic proximity of the magnet to cause releasable fixation of the necktie relative to the shirt at the location of the magnet. As before, the magnet may optionally be magnetized to about Grade N35 and may optionally be comprised of a rare Earth material that is encased in a hard and durable coating to protect it from corrosion. The coating on the magnet may comprise at least nickel or epoxy. In addition, the second pocket may be secured between the transverse piece of fabric and the rear side of the ornamental end of the necktie.

Yet another method for using a magnet in combination with a faceplate for securing a necktie to a shirt is presented in accordance with one aspect of the present invention. The necktie comprises an ornamental end and a nonornamental end that is positioned behind a transverse piece of fabric secured to the rear portion of the ornamental end. The method comprises the steps of: (1) placing and holding the magnet underneath at least a portion of the shirt with one hand; (2) placing and holding the faceplate in front of the ornamental end of the necktie with the other hand; and (3) drawing the faceplate toward the magnet to become within magnetic proximity of one another to cause releasable fixation of the necktie relative to the shirt at the location of the magnet. In this aspect of the invention, the faceplate may be decorative for prominent display in front of the necktie, and the magnet may also be magnetized to about Grade N35.

Another method for using a magnet in combination with a faceplate for securing a necktie to a shirt is presented in accordance with one aspect of the present invention. The necktie comprises an ornamental end and a nonornamental end that is positioned behind a transverse piece of fabric secured to the rear portion of the ornamental end. The method comprises the steps of: (1) inserting a pin secured to the magnet through the shirt; (2) fastening a clasp to the pin to secure the magnet to the shirt; (3) placing and holding the faceplate in front of the ornamental end of the necktie; and (4) drawing the faceplate toward the magnet to become within magnetic proximity of one another to cause releasable restraint of the necktie relative to the shirt at the location of the magnet. In this aspect of the invention, the faceplate may be decorative for prominent display in front of the necktie, and the magnet may be magnetized to about Grade N35.

Yet another method for using a magnet in combination with a faceplate for securing a necktie to a shirt is presented in accordance with one aspect of the present invention. The necktie comprises an ornamental end and a nonornamental end that is positioned behind a transverse piece of fabric secured to the rear portion of the ornamental end. The method comprises the steps of: (1) inserting a bar through a buttonhole in the shirt, the bar being connected to a tether having a predetermined length and the tether being attached to the magnet; (2) supporting the tethered magnet with one hand; (3) placing and holding the faceplate in front of the ornamental end of the necktie with the other hand; and (3) drawing the faceplate toward the magnet to become within magnetic proximity of one another to cause releasable restraint of the necktie relative to the shirt to the extent of the length of the tether. As before, in this aspect of the invention, the faceplate is optionally decorative for prominent display in front of the necktie, and the magnet is optionally magnetized to about Grade N35.

DETAILED DESCRIPTION OF THE INVENTION

Figure 1:
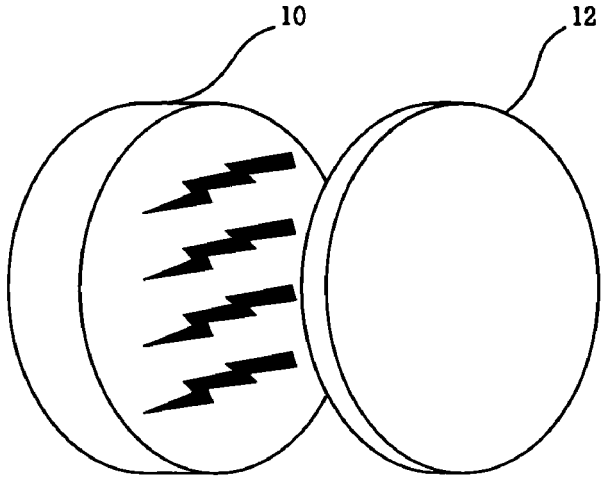
FIG. 1 is a perspective view according to one embodiment of the invention of a permanent magnet in combination with a faceplate attractable to the magnet.

While this invention is susceptible of embodiment in many different forms, there are shown in the drawings and described in detail, certain preferred embodiments with the understanding that the present disclosure should be considered as an exemplification of the principles of the invention and is not intended to limit the invention to the embodiments so illustrated.

Figure 2:
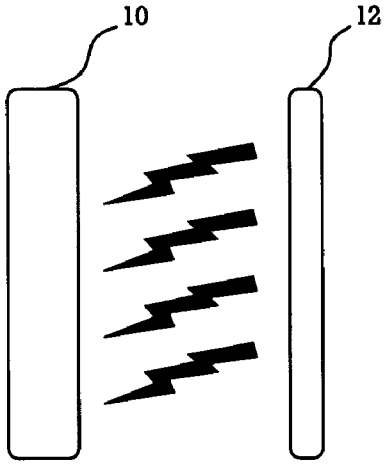
FIG. 2 is a side view of the embodiment of FIG. 1.
Figure 3:
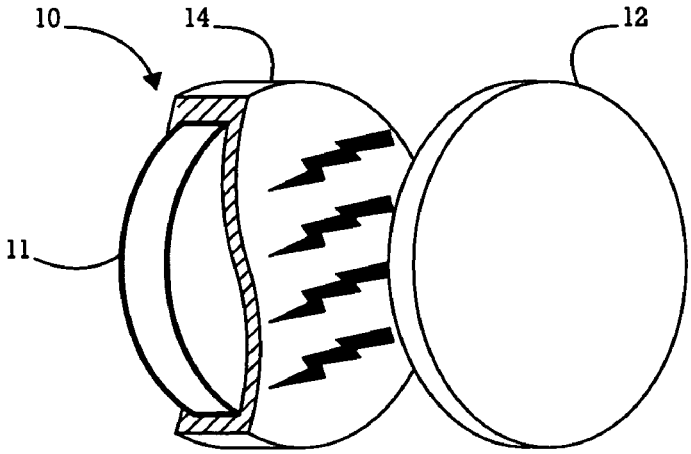
FIG. 3 is a detail perspective view of the embodiment of FIG. 1 showing the magnet and its protective outer coating.

FIGS. 1-3 describe a generic magnet and faceplate combination as used in the present invention. Magnet 10 is preferably made from a rare Earth material 11, such as Neodymium Iron Boron (NdFeB), sintered to form a permanent magnet of about Grade N35 (i.e. preferably a magnet having BHmax equal to about 33 to 35 Million Gauss Oersted energy units (MGOe), where BHmax is the maximum product of the induction (B) measured in Gauss units and the magnetic field strength (H) measured in Oersted units). Magnet 10 is encased by coating 14 to prevent corrosion of the underlying rare Earth substrate. Besides protecting rare Earth material 11 from corrosion, coating 14 is preferably made of at least nickel or epoxy to produce a hard and impact resistant outer surface for enhanced durability and longevity of the overall magnet 10. Other materials, however, such as copper, tin, zinc, silver, gold and the like, are optionally available to protect rare Earth material 11 from corrosion, but may result in a higher cost or durability penalty.

While magnet 10 is preferably made of a rare Earth material, faceplate 12 is preferably made of any material attractable to magnet 10 to achieve the lowest cost without sacrificing functionality. However, faceplate 12 may optionally have magnetic properties of its own, and may even have physical and magnetic properties similar to that of magnet 10.

Magnet 10 and faceplate 12 are each preferably relatively thin discs, as shown in FIGS. 1-3, of about ½ inch diameter and about ⅛ inch thick to provide a relatively small and thin footprint and to yield a magnetic axial pull force of about 5 lbs. Alternatively, magnet 10 and/or faceplate 12 may be formed in the shape of a relatively thin square or rectangle of similar dimensions. Regardless of the geometry, magnet 10 should provide a magnetic axial pull force of no less than about 3 lbs to insure adequate margin exists to hold a necktie, and no greater than about 11 lbs to minimize the chances of personal injury or damage to clothing. Permanent rare Earth magnets having all of these properties, coatings and/or geometry are available at retail outlets such as www.kjmagnetics.com or www.wondermagnetics.com, for example.

Figure 4:
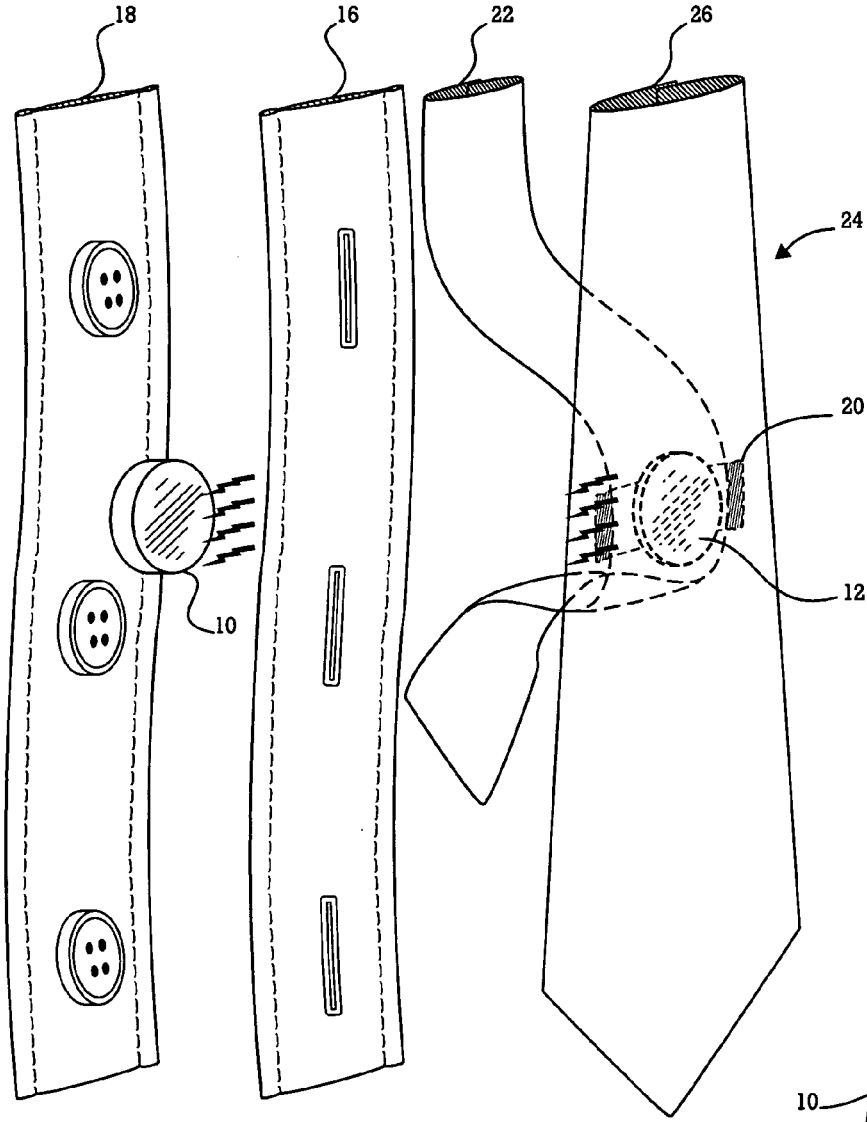
FIG. 4 is a perspective view of the embodiment of FIG. 1 showing the magnet positioned behind the front panel of a shirt and showing the faceplate positioned behind a transverse piece of fabric (i.e. such as the manufacturer's label) on the back of a necktie.
Figure 5:
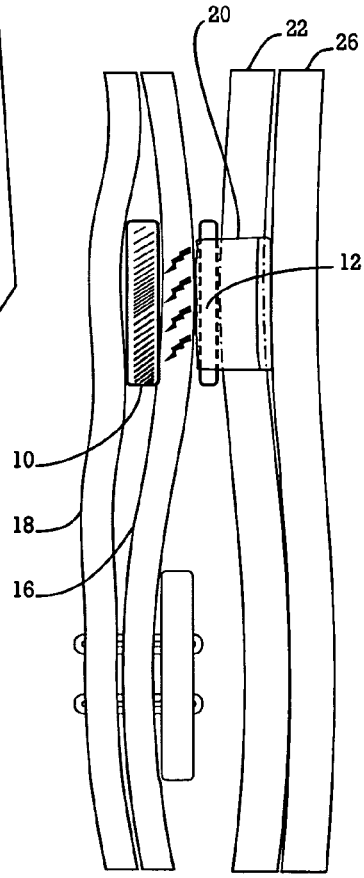
FIG. 5 is a side view of the embodiment of FIG. 4.

FIGS. 4-5 describe one embodiment of the present invention. Magnet 10 and faceplate 12, in combination, can be used to noninvasively restrain a necktie relative to the wearer's shirt while simultaneously being completely hidden from view. For example, with nonornamental end 22 of necktie 24 already positioned behind transverse fabric (i.e. the manufacturer's label) 20, itself secured along two edges to the back of ornamental end 26 to form a "hole" through which nonormental end 22 is "threaded", a user of the present invention holding magnet 10 in one hand and faceplate 12 in the other would first insert and hold magnet 10 between front shirt panel 16 and rear shirt panel 18 at a position proximate to the location of transverse fabric 20 when the necktie is comfortably worn and draped in front of the wearer. With the other hand, the user would then insert and hold faceplate 12 behind transverse fabric 20. Next, the user would draw together magnet 10 and faceplate 12 to be within magnetic proximity with one another to cause transverse fabric 20 and front shirt panel 16 to lie fixedly in contact with one another between magnet 10 and faceplate 12. Reversing this procedure allows the wearer to separate the garments from one another quickly and with relative ease. Notably, this embodiment as thus described is contemplated to work with varying thicknesses and/or layers of fabric. Therefore, faceplate 12 may optionally be inserted behind transverse fabric 20 and between ornamental end 26 and nonornamental end 22 of necktie 24 to cause transverse fabric 20, nonornamental end 22, and front shirt panel 16 to lie fixedly in contact with one another between magnet 10 and faceplate 12.

Figure 6:
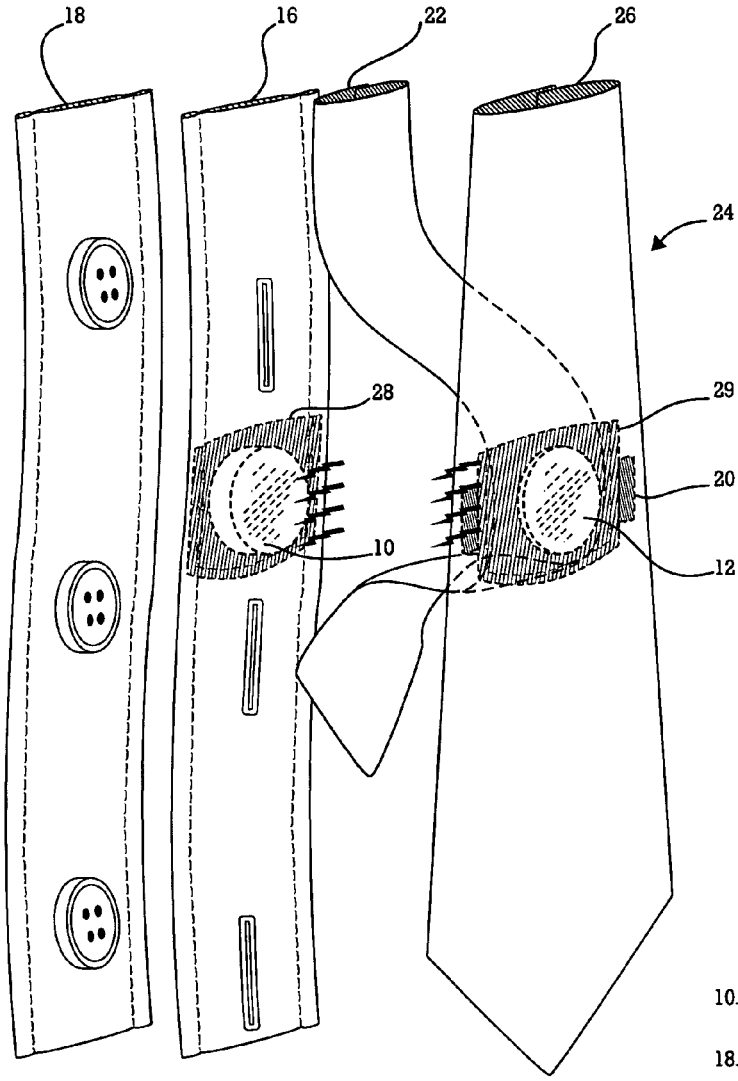
FIG. 6 is a perspective view of the embodiment of FIG. 1 showing the magnet and the faceplate positioned inside pockets fabricated in a shirt and a necktie, respectively.
Figure 7:
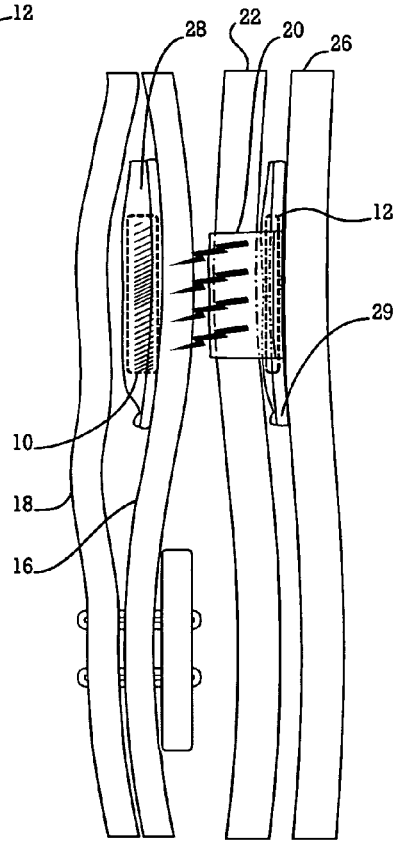
FIG. 7 is a side view of the embodiment of FIG. 6.
Figure 8:
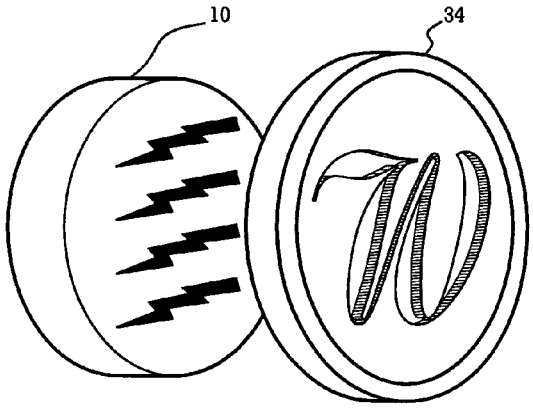
FIG. 8 is a perspective view according to another embodiment of the invention of a permanent magnet in combination with a decorative faceplate attractable to the magnet.
Figure 11:
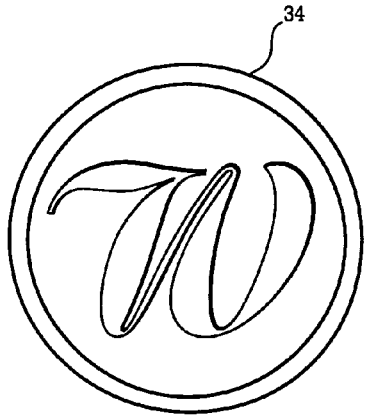
FIG. 11 is a front view of the embodiment of FIG. 8.
Figure 9:
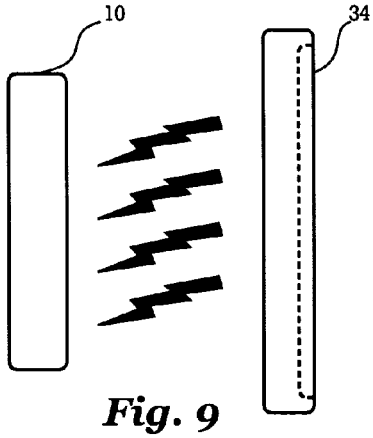
FIG. 9 is a side view of the embodiment of FIG. 8.
Figure 12:
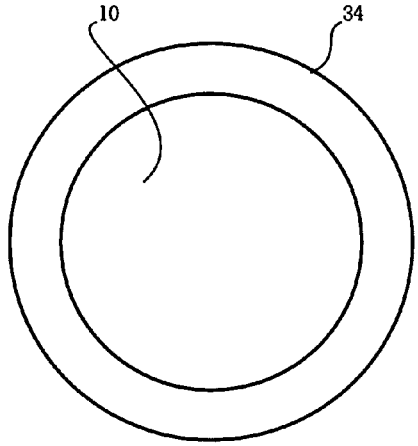
FIG. 12 is a rear view of the embodiment of FIG. 8.
Figure 10:
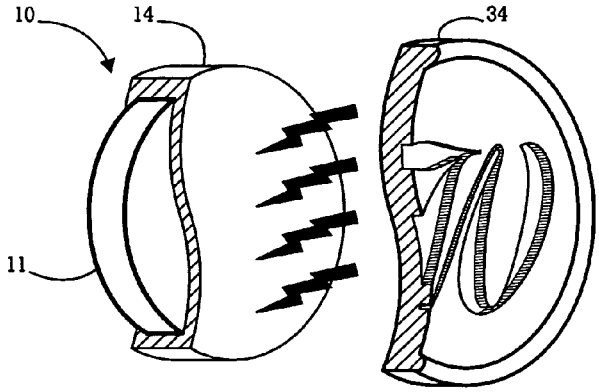
FIG. 10 is a detail perspective view of the embodiment of FIG. 8 showing the magnet and its protective outer coating.

FIGS. 6-7 describe another embodiment of the present invention. In this embodiment, the shirt and/or necktie manufacturer may provide pockets 28, 29 to house one or both of magnet 10 and faceplate 12 so as to potentially be completely hidden from view while also enabling the necktie to be fixedly in contact with the surface of the shirt at the location of the holder. Pocket 28 is preferably positioned on the backside of front shirt panel 16 while pocket 29 is preferably positioned on the backside of ornamental end 22 of necktie 24.

In this embodiment, pockets 28, 29 are preferably sewn on only three sides (leaving the top seam open) to permit easy removal of magnet 10 and/or faceplate 12 from their respective garments to facilitate unencumbered ironing of the garments when needed. Though pockets 28, 29 are illustrated in use together in this embodiment, it is contemplated that any combination of the embodiment of FIGS. 4-5 and FIGS. 6-7 is possible. Therefore, the present invention will work if magnet 10 is optionally inserted behind front shirt panel 16 and faceplate 12 is installed in pocket 29. Likewise, the present invention will work if magnet 10 is installed in pocket 28 and faceplate 12 is optionally inserted behind transverse fabric 20.

Preferably, with the nonornamental end 22 of necktie 24 behind transverse fabric (i.e. the manufacturer's label) 20, itself secured along two edges to the back of ornamental end 26 to form a "hole" through which nonormental end 22 is "threaded", a user of this embodiment of the invention would first insert the magnet in pocket 28 secured underneath front shirt panel 16. Next, the user would insert faceplate 12 in pocket 29 secured to the back of ornamental end 26. Then, the user would draw necktie 24 toward front shirt panel 16 to cause magnet 10 and faceplate 12 to be within magnetic proximity with one another to cause transverse fabric 20 to lie fixedly in contact with front shirt panel 16. Reversing this procedure allows the wearer to separate the garments from one another quickly, with relative ease, and with complete capture and/or retention of all components of the necktie holder of the present invention.

Instead of first preparing necktie 24 by "threading" nonornamental end 22 behind transverse fabric 20, the user may optionally choose to first insert magnet 10 in pocket 28 (or faceplate 12 in pocket 29, for that matter), then insert faceplate 12 in pocket 29 (or magnet 10 in pocket 28), before positioning nonornamental end 22 behind transverse fabric 20 and drawing necktie 24 toward front panel 16.

FIGS. 8-12 illustrate another magnet and faceplate combination in which magnet 10 is used together with alternative faceplate 34. Like faceplate 12, faceplate 34 is preferably made of any material attractable to magnet 10. However, the present invention will work even if faceplate 34 has physical and magnetic properties of its own, similar to that of magnet 10.

Faceplate 34 is preferably decorative in nature for prominent display in front of a necktie, as opposed to being hidden from view as previously described in FIGS. 4-7. But if a wearer no longer wishes to display decorative faceplate 34, the wearer may optionally install faceplate 34 in the manner shown and described in FIGS. 4-7.

Decorative faceplate 34 may include jewels or other similar decorative or precious metal items. In addition, faceplate 34 may also include engravings, etchings, geometric shapes, company logos or group affiliations, flags and insignia, awards, religious ornamentation and licensed characters, to name a few. In fact, an endless array of shapes, sizes, colors and indicia may be included on, with, and/or in faceplate 34 without interfering with the functionality of the device. The various designs of faceplate 34 are completely interchangeable with one another without inhibiting the functionality of the overall device.

Figure 13:
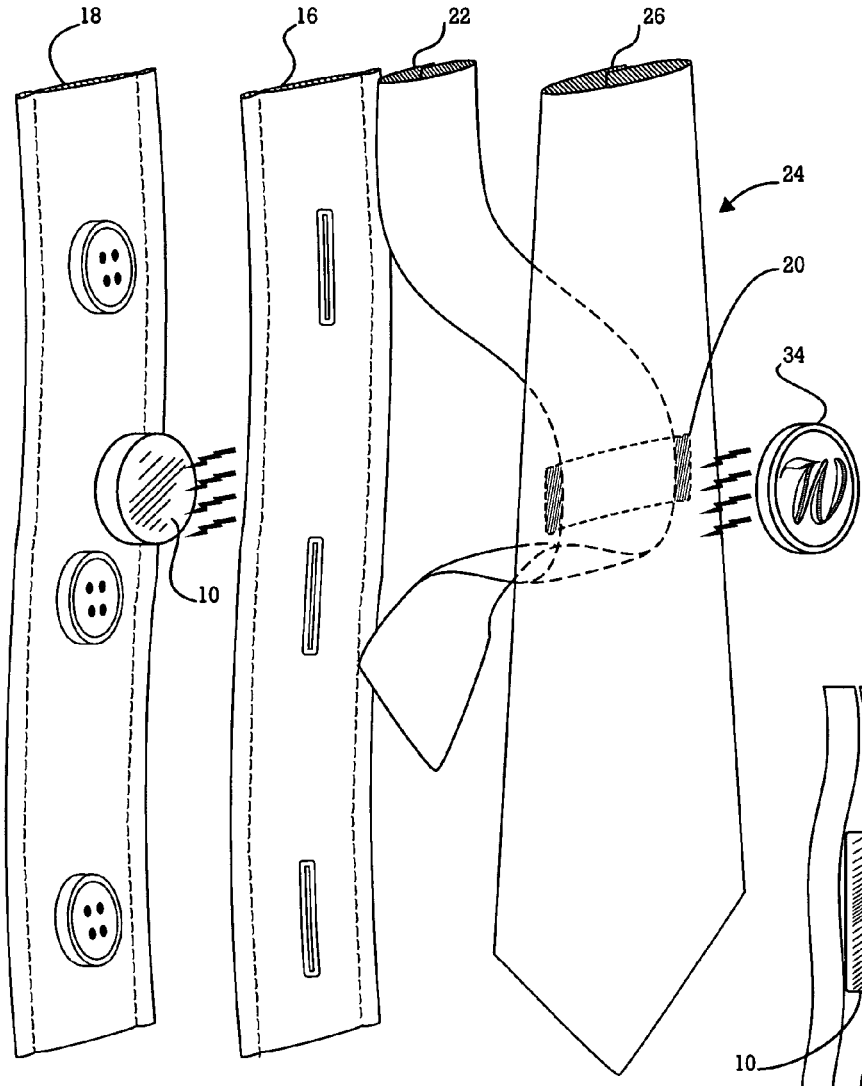
FIG. 13 is a perspective view of the embodiment of FIG. 8 showing the magnet positioned behind the front panel of a shirt and showing the faceplate positioned in front of the necktie.
Figure 14:
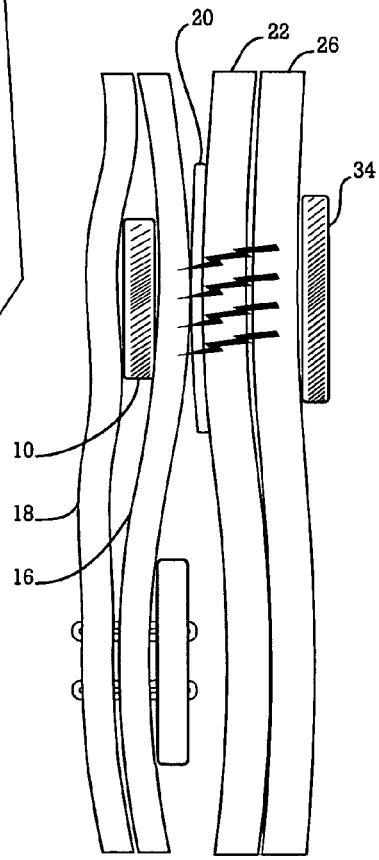
FIG. 14 is a side view of the embodiment of FIG. 13.

FIGS. 13-14 describe another embodiment of the present invention where the necktie is fixedly placed into direct contact with the surface of the shirt at the location of the holder. Magnet 10 and faceplate 34, in combination, can be used to noninvasively restrain a necktie relative to the wearer's shirt so as not to cause damage to either garment. For example, with nonornamental end 22 of necktie 24 already positioned behind transverse fabric (i.e. the manufacturer's label) 20, itself secured along two edges to the back of ornamental end 26 to form a "hole" through which nonormental end 22 is "threaded", a user of this embodiment of the present invention holding magnet 10 in one hand and faceplate 34 in the other would first insert and hold magnet 10 between front shirt panel 16 and rear shirt panel 18 at a vertical position of their choice. Using the other hand, the user would then position and hold faceplate 34 in front of ornamental end 26 proximate the chosen location of magnet 10. Next, the user would draw together magnet 10 and faceplate 34 to be within magnetic proximity with one another to cause necktie 24 (and its component ends 22, 24 and possibly even transverse fabric 20) and front shirt panel 16 to lie fixedly in contact with one another between magnet 10 and faceplate 34. Reversing this procedure allows the wearer to separate the garments from one another quickly and with relative ease. Of course, the present invention would also work if magnet 10 were installed in pocket 28 should it exist on the wearer's shirt.

Figure 15:
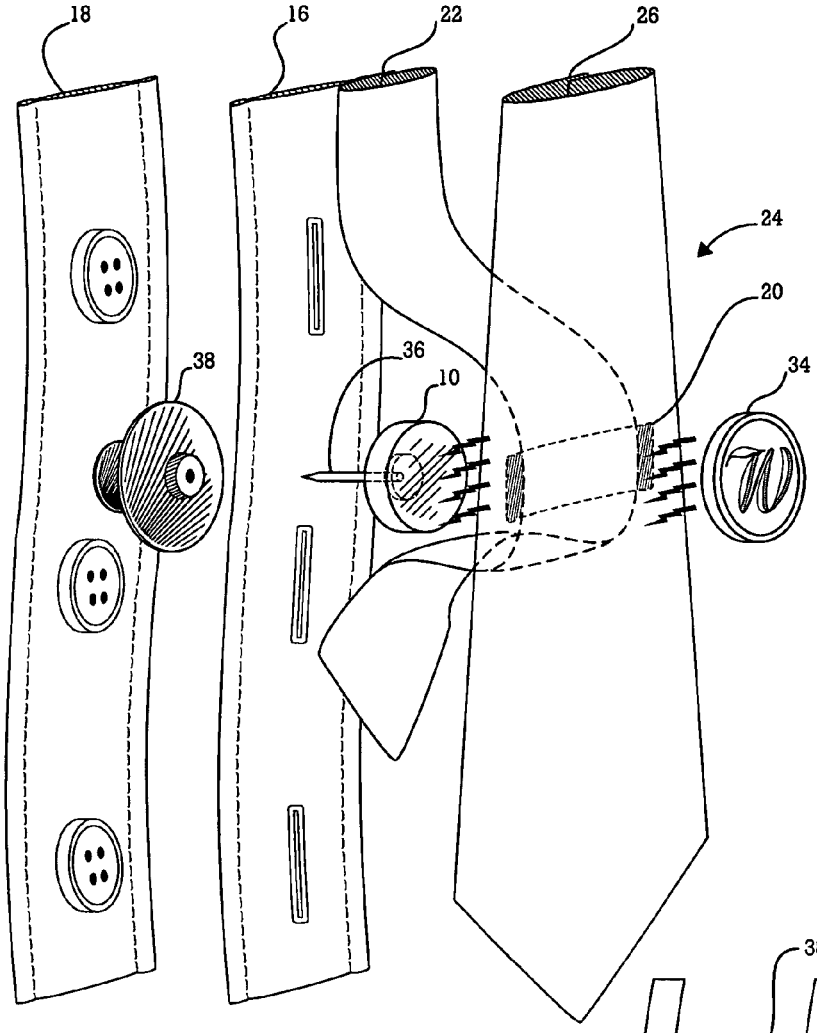
FIG. 15 is a perspective view of an alternative embodiment of a permanent magnet having a pin and a clasp in combination with a decorative faceplate.
Figure 16:
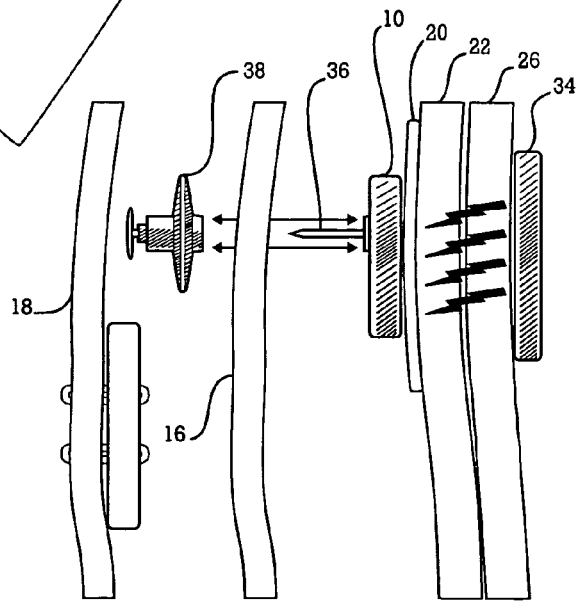
FIG. 16 is a side view of the embodiment of FIG. 15.

FIGS. 15-16 describe yet another embodiment of the present invention. Magnet 10 includes pin 36 and clasp 38 to secure magnet 10 to at least front shirt panel 16. Pin 36 may be attached to magnet 10 using any number of conventional means, including but not limited to, gluing, tack welding or brazing, or by an interference fit to the outer diameter of magnet 10. Clasp 38 is any conventional clasp capable of being secured to pin 36, such as through a mild friction fit.

A user of this embodiment of the present invention would first push pin 36 of magnet 10 through at least front shirt panel 16 (possibly even through an open buttonhole) at a vertical location chosen by the user. The user would then push clasp 38 onto pin 36 to securely restrain magnet 10 to at least front shirt panel 16. With nonornamental end 22 of necktie 24 already positioned behind transverse fabric 20, itself secured along two edges to the back of ornamental end 26 to form a "hole" through which nonormental end 22 is "threaded", the user would position faceplate 34 in front of ornamental end 26 of necktie 24 at approximately the same location as magnet 10. Next, the user would draw together magnet 10 and faceplate 34 to be within magnetic proximity with one another to cause necktie 24 (and its component ends 22, 24 and possibly even transverse fabric 20) and at least front shirt panel 16 to lie secured between magnet 10 and faceplate 34. Reversing this procedure allows the wearer to separate the garments from one another quickly and with relative ease. Of course, this embodiment of the present invention would also work if faceplate 12 were substituted for faceplate 34 and installed as described in FIGS. 4-5 and FIGS. 6-7 (if pocket 29 should exist on the wearer's necktie).

Use of this embodiment of the present invention may cause a potentially undesirable hole to be formed in at least the front shirt panel 16 (unless the pin is pushed through an open button hole), however, it retains the advantages of quick disconnect of the necktie from the shirt, creates no undesirable holes in the necktie, includes a decorative faceplate, and has the added advantage of retention of magnet 10 to at least front shirt panel 16 regardless of the presence of faceplate 34.

Figure 17:
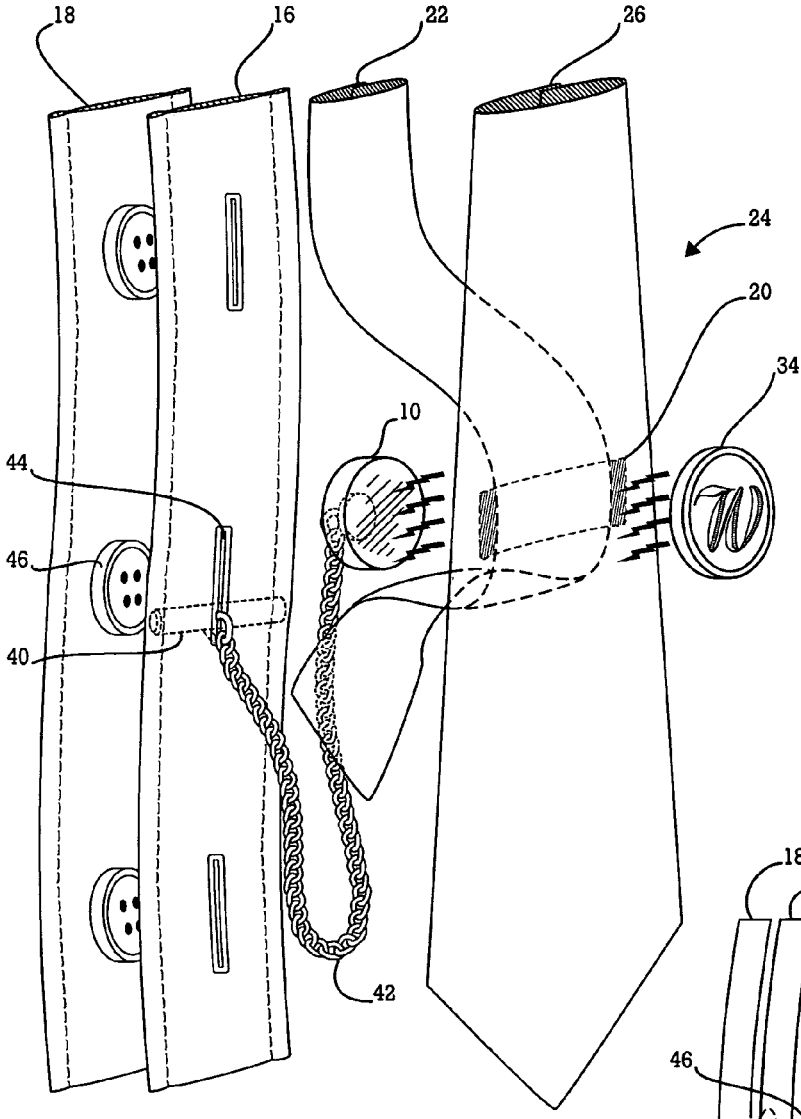
FIG. 17 is a perspective view of yet another embodiment of a permanent magnet having a tether and a bar in combination with a decorative faceplate.

FIGS. 16-17 describe yet another embodiment of the present invention. Magnet 10 includes bar 40 and tether 42 to secure magnet 10 to at least front shirt panel 16. Tether 42 is preferably made of conventional jewelry-grade materials and design, and may be attached to magnet 10 using any number of conventional means, including but not limited to, gluing, tack welding or brazing, or by an interference fit to the outer diameter of magnet 10. One potential method of securing bar 40 to tether 42 is by threading the end of tether 42 through a hole formed through bar 40.

Figure 18:
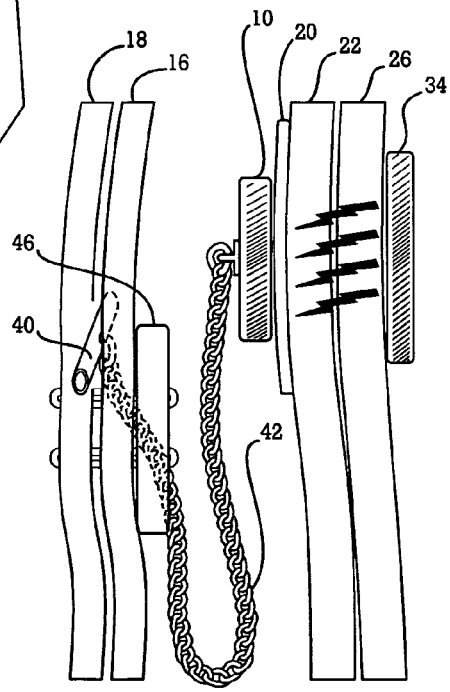
FIG. 18 is a side view of the embodiment of FIG. 17.

A user of this embodiment of the present invention would first insert bar 40 through buttonhole 44 chosen by the user in front shirt panel 16. Buttonhole 44 captures bar 40 as shown in FIGS. 17-18 and effectively retains magnet 10 to front shirt panel 16 whenever faceplate 12 or 34 is not actively engaged with magnet 10. The size and geometry of the installed bar 40 and tether 42 combination do not inhibit the normal use of button 46 in buttonhole 44.

With nonornamental end 22 of necktie 24 already positioned behind transverse fabric (i.e. the manufacturer's label) 20, itself secured along two edges to the back of ornamental end 26 to form a "hole" through which nonormental end 22 is "threaded", a user of this embodiment of the present invention holding magnet 10 in one hand and faceplate 34 in the other would next position both pieces (10 and 34) on either side of necktie 24. Next the user would draw together magnet 10 and faceplate 34 to be within magnetic proximity with one another to cause necktie 24 (and its component ends 22, 24 and possibly even transverse fabric 20) to lie secured between magnet 10 and faceplate 34. Reversing this procedure allows the wearer to separate the garments from one another quickly and with relative ease but with the added convenience of retention of magnet 10 to front shirt panel 16. Most importantly, however, this embodiment allows for some limited movement of necktie 24 relative to front shirt panel 16, up to the length of tether 42. Of course, this embodiment of the present invention would also work if faceplate 12 were substituted for faceplate 34 and installed as described in FIGS. 4-5 and FIGS. 6-7 (if, for example, pocket 29 should exist on the wearer's necktie).

The present invention may also incorporate elements of FIGS. 15-16 and FIGS. 17-18 in still another embodiment (not shown). For example, clasp 38 may be mounted to the end of tether 42, thereby replacing magnet 10 on the end of tether 42. Tether 42 could be secured to front shirt panel 16 via bar 40. A wearer of this clasp/tether combination may then use faceplate 12 or 34 in accordance with the teachings of FIGS. 4-7 and FIGS. 13-17.

Besides that which has been shown and described for securing neckties to dress shirts, other uses of the present invention include securing socks together (even potentially during washing), replacing traditional securing means (i.e. pins and the like) in authentic cultural attire, replacing traditional shirt buttons, trouser closures, and cufflinks, holding a corporate badge or exposition name tag to one's outer garment, holding corsages or similar floral arrangements to one's lapel, securing strapless braziers to ladies' blouses, and as wardrobe clips to quickly and temporarily hold gowns or other garments in place on photographer's subjects.

As noted above, while faceplate 12 and faceplate 34 will work as shown and described even if they have similar physical and magnetic properties to that of magnet 10, faceplate 12 and faceplate 34 are preferably nonmagnetic themselves. The reason is simple—the significant field strength presented by Grade N35 magnets or similar give rise to manufacturing issues that are minimized if faceplates 12 and 34 are nonmagnetic. Specifically, a magnetized faceplate may be difficult to silkscreen or otherwise process than a nonmagnetized faceplate because a magnetized faceplate would be attracted to the very machine used in processing it and potentially jam in the machinery. Therefore, processing operations for nonmagnetic faceplates 12 and 34 enhances manufacturability without sacrificing functionality of the invention.

The foregoing description and drawings merely explain and illustrate the invention, and the invention is not so limited as those skilled in the art who have the disclosure before them will be able to make modifications and variations therein without departing from the scope of the invention.

What is claimed is:

1. A method for using a magnet in combination with a faceplate for securing a necktie to an article of clothing, the necktie comprising an ornamental end and a nonornamental end positioned behind a transverse piece of fabric secured to a rear side of the ornamental end, the method comprising the steps of:

placing the magnet in a first pocket secured between an outer flap and an inner flap of the article of clothing and between two buttonholes positioned vertically along the outer flap to avoid interference with the use of the buttonholes, wherein the magnet is removably placeable in the first pocket;

placing the faceplate in a second pocket secured to the rear side of the ornamental end, the second pocket being positioned between the transverse piece of fabric and the rear side of the ornamental end and between two opposing lateral ends of the transverse piece of fabric to hide the second pocket from view while permitting a normal appearance and function of the ornamental end with respect to the nonornamental end of the necktie, wherein the faceplate is removably placeable in the second pocket; and drawing the necktie toward the article of clothing to cause the faceplate to become within magnetic proximity of the magnet to cause releasable fixation of the necktie relative to the article of clothing at the location of the magnet.

2. The method according to claim 1, wherein the magnet is magnetized to about Grade N35.

3. The method according to claim 2, wherein the magnet is comprised of a rare Earth material that is encased in a hard and durable coating to protect it from corrosion.

4. The method according to claim 3, wherein the coating comprises at least nickel or epoxy.

5. The method according to claim 1, wherein the first pocket is secured to the article of clothing on three sides of the first pocket to permit the removable placement of the magnet in the first pocket.

6. A system for securing a necktie to a shirt, comprising:

a shirt comprising a first pocket secured to a rear side of an outer flap of the shirt, wherein the first pocket is positioned between the outer flap and an inner flap of the shirt, wherein a magnet is removably insertable in the first pocket;

a necktie comprising a second pocket secured to a rear side of an ornamental end of the necktie, wherein a faceplate is removably insertable in the second pocket;

wherein the necktie is capable of being drawn toward the shirt to cause the faceplate to become within magnetic proximity of the magnet to cause releasable fixation of the necktie relative to the shirt at the location of the magnet.

7. The system according to claim 6, wherein the first pocket is secured to the shirt on three sides of the first pocket to permit the removable insertion and retention of the magnet in the first pocket.

8. The system according to claim 6, wherein the magnet is magnetized to about Grade N35 and comprises a nickel coating.

9. A system for securing a necktie to a shirt, comprising:

a shirt having a first pocket secured to a rear side of an outer flap of the shirt and along three sides of the first pocket, the first pocket positioned vertically between two buttonholes and laterally between the outer flap and an inner flap of the shirt;

a necktie having a second pocket secured to a rear side of an ornamental end of the necktie, the second pocket being secured to the necktie along three sides of the second pocket and positioned between a transverse piece of fabric and the rear side of the ornamental end;

a magnet that is removably insertable into the first pocket; and a faceplate that is removably insertable into the second pocket, wherein the necktie is capable of being drawn toward the shirt to cause the faceplate to become within magnetic proximity of the magnet to cause releasable fixation of the necktie relative to the shirt at the location of the magnet.

10. The system according to claim 9, wherein the magnet is magnetized to about Grade N35 and comprises a nickel coating.

11. The system according to claim 9, wherein the faceplate is magnetized to about Grade N35 and comprises a nickel coating.

12. The system according to claim 9, wherein the transverse piece of fabric is secured to the rear side of the ornamental end to form an aperture for receiving a nonornamental end of the necktie.

13. The system according to claim 12, wherein the second pocket lies between respective lateral ends of the transverse piece of fabric to hide the second pocket from view.

14. The system according to claim 13, wherein the system forms an invisible connection between the necktie and the shirt wherein the nonomamental end is unrestrained below the transverse piece of fabric to create a normal appearance and function of the ornamental end with respect to the nonornamental end of the neckties.

* * * * *

UNITED STATES PATENT AND TRADEMARK OFFICE

CERTIFICATE OF CORRECTION

PATENT NO. : 7,373,696 B2
APPLICATION NO. : 10/918882
DATED : May 20, 2008
INVENTOR(S) : Brian Schoening et al.

It is certified that error appears in the above-identified patent and that said Letters Patent is hereby corrected as shown below:

Column 6, Line 8, delete “nonormetal” and replace with --nonornamental--.

Column 8, Lines 7-8, delete “nonor-mental” and replace with --nonornamental--.

Claim 14, Column 10, Line 47, delete “nonomamental” and replace with --nonornamental--.

Claim 14, Column 10, Line 51, delete “neckties” and replace with --necktie--.

Signed and Sealed this

Fifth Day of August, 2008

JON W. DUDAS
*Director of the United States Patent and Trademark Office*